US011059153B2

(12) United States Patent
Shehab

(10) Patent No.: US 11,059,153 B2
(45) Date of Patent: Jul. 13, 2021

(54) BIT PULLER

(71) Applicant: The Boeing Company, Chicago, IL (US)

(72) Inventor: Kareem Gamal Shehab, Seattle, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/734,326

(22) Filed: Jan. 4, 2020

(65) Prior Publication Data

US 2020/0139526 A1 May 7, 2020

Related U.S. Application Data

(62) Division of application No. 15/055,988, filed on Feb. 29, 2016, now Pat. No. 10,688,638.

(51) Int. Cl.
*B25B 27/18* (2006.01)
*B25B 27/02* (2006.01)

(52) U.S. Cl.
CPC ..... *B25B 27/18* (2013.01); *B25B 27/023* (2013.01)

(58) Field of Classification Search
CPC ..... B25B 27/18; B25B 27/023; B25B 23/103; B23B 47/00; B23B 31/06; B23B 47/284
See application file for complete search history.

(56) References Cited

U.S. PATENT DOCUMENTS 965,054 A * 7/1910 Weekes ..... B25B 9/00 294/100
3,727,491 A * 4/1973 Buckwalter ..... B25B 27/023 81/53.2
6,435,782 B1 * 8/2002 Hillhouse ..... B23B 47/284 29/402.03

* cited by examiner

*Primary Examiner* — Lee A Holly
(74) *Attorney, Agent, or Firm* — Felix L. Fischer

(57) ABSTRACT

A bit puller incorporates an inner element with a longitudinal axis and having a central shaft, a base with external threads and an engagement mechanism internal to the inner element adapted to engage a drill bit. An outer element is concentric with the inner element and has a foot portion for engaging a work piece. Internal threads in the outer element are adapted to engage the external threads of the base wherein rotation of the inner element with respect to the outer element withdraws the inner element along the longitudinal axis.

20 Claims, 8 Drawing Sheets

BIT PULLER

REFERENCE TO RELATED APPLICATIONS

This application is a divisional of U.S. application Ser. No. 15/055,988 filed on Feb. 29, 2016, now U.S. Pat. No. 10,688,638 issued on Jun. 23, 2020, having a common assignee with the present application, the disclosure of which is incorporated herein by reference.

BACKGROUND INFORMATION

Field

Embodiments of the disclosure relate generally to devices for removing drill bits from a workpiece and more particularly to a system employing an inner element to engage the drill bit and having an externally threaded portion engaged by inner thread on an outer element adapted to engage a surface of the workpiece whereby rotation of the inner element within the outer element withdraws the inner element and bit from the workpiece.

Background

Drill bits may bind within a drill bore in a workpiece. This may be due to the bit dulling, removed material clogging the hole, or other situations. The drill motor can be run in reverse to back the drill bit out, but this may not work for very stuck drill bits (especially, where the removed material jams the flutes of the drill bit). A prying device, such as a claw hammer or pry bar, can be used to pull the drill bit from the workpiece, but these devices pull the drill bit off center during removal, which may damage or alter the hole or workpiece or break the drill bit off in the workpiece. Often, attempted extraction with the drill motor or other machine tool may fracture the bit or damage the workpiece. The bit may become stuck at any depth which complicates removal since a normal collet attachment to the bit requires attachment proximate the end of the shaft which may be spaced from the workpiece allowing undesirable bending torque to be exerted on the bit increasing the likelihood of fracturing the bit.

Several known tools pull a drill bit or similar element out of a workpiece on center with the hole. However, these tools include jaws that are tightened on to the drill bit by using screws through a portion of the jaws. These screws may be difficult to access depending on where the drill bit is or may be time consuming to tighten and loosen. Further, the tools are fairly complicated because they include several different components that need to work together to attach to the drill bit and to pull the drill bit from the workpiece.

SUMMARY

Embodiments disclosed herein provide a bit puller incorporating an inner element with a longitudinal axis and having a central shaft, a base with external threads and an engagement mechanism internal to the inner element adapted to engage a drill bit. An outer element is concentric with the inner element and has a foot portion for engaging a work piece. Internal threads in the outer element are adapted to engage the external threads of the base wherein rotation of the inner element with respect to the outer element withdraws the inner element along the longitudinal axis.

The embodiments allow a method for extraction of a drill bit wherein a drill bit is engaged in an attachment mechanism internal to an inner element. An outer element having internal threads is received on external threads on the inner element. The inner element is then rotated with respect to the outer element urging a foot portion of the outer element into contact with a workpiece and withdrawing the inner element on a longitudinal axis thereby extracting the drill bit.

The features, functions, and advantages that have been discussed can be achieved independently in various embodiments of the present disclosure or may be combined in yet other embodiments, further details of which can be seen with reference to the following description and drawings.

DETAILED DESCRIPTION

The embodiments described herein provide a method and tool for operation to allow removal of drill bits, which may engage the bit at any drill depth. Further, the system is self-engaging for ease in removing the bit.

Embodiments disclosed herein provide a bit puller having an inner element adapted to engage the drill bit and having an external threaded surface. The inner element includes a drive connection for rotation of the inner element. An outer element has an internal thread adapted to concentrically engage the external threaded surface of the inner element at an adjustable height whereby the drill bit may be engaged by the inner element at any depth of penetration at which binding has occurred. The outer element has a foot portion engaging the workpiece concentrically surrounding the drill bit. Rotation of the inner element with the drive connection rotates the outer threads of the inner element within the inner threads of the outer element to withdraw the inner element through the outer element thereby drawing the bit engaged by the inner element from the workpiece. While the embodiments are described herein with respect to removal of a binding drill bit, the structure of the embodiments may be employed for removal of other machine tools or implements which may extend from a workpiece such as end mills, press fit shafts, or even nails.

Figure 1A:
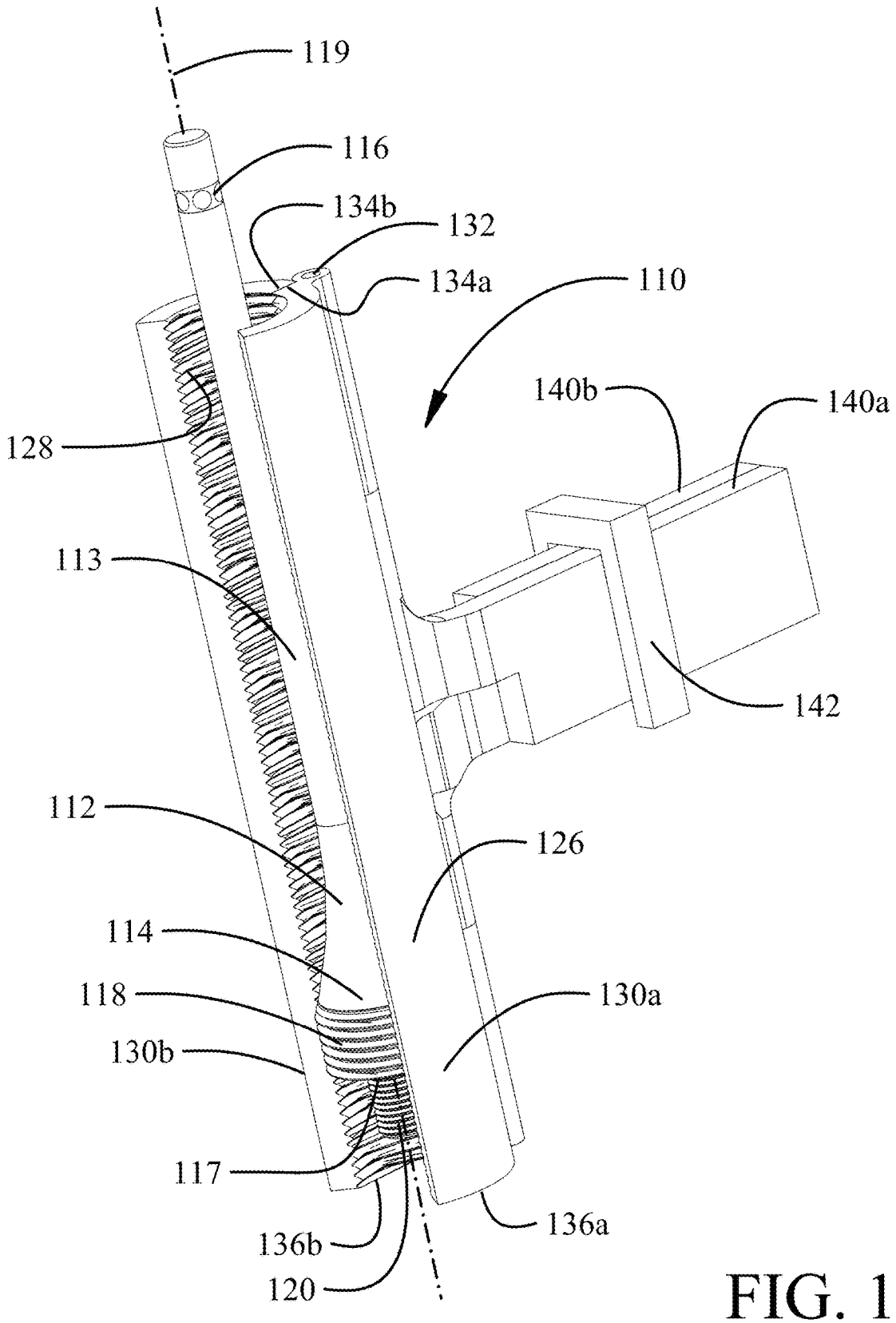
FIG. 1A is a pictorial representation of a first embodiment of the bit puller.
Figure 1B:
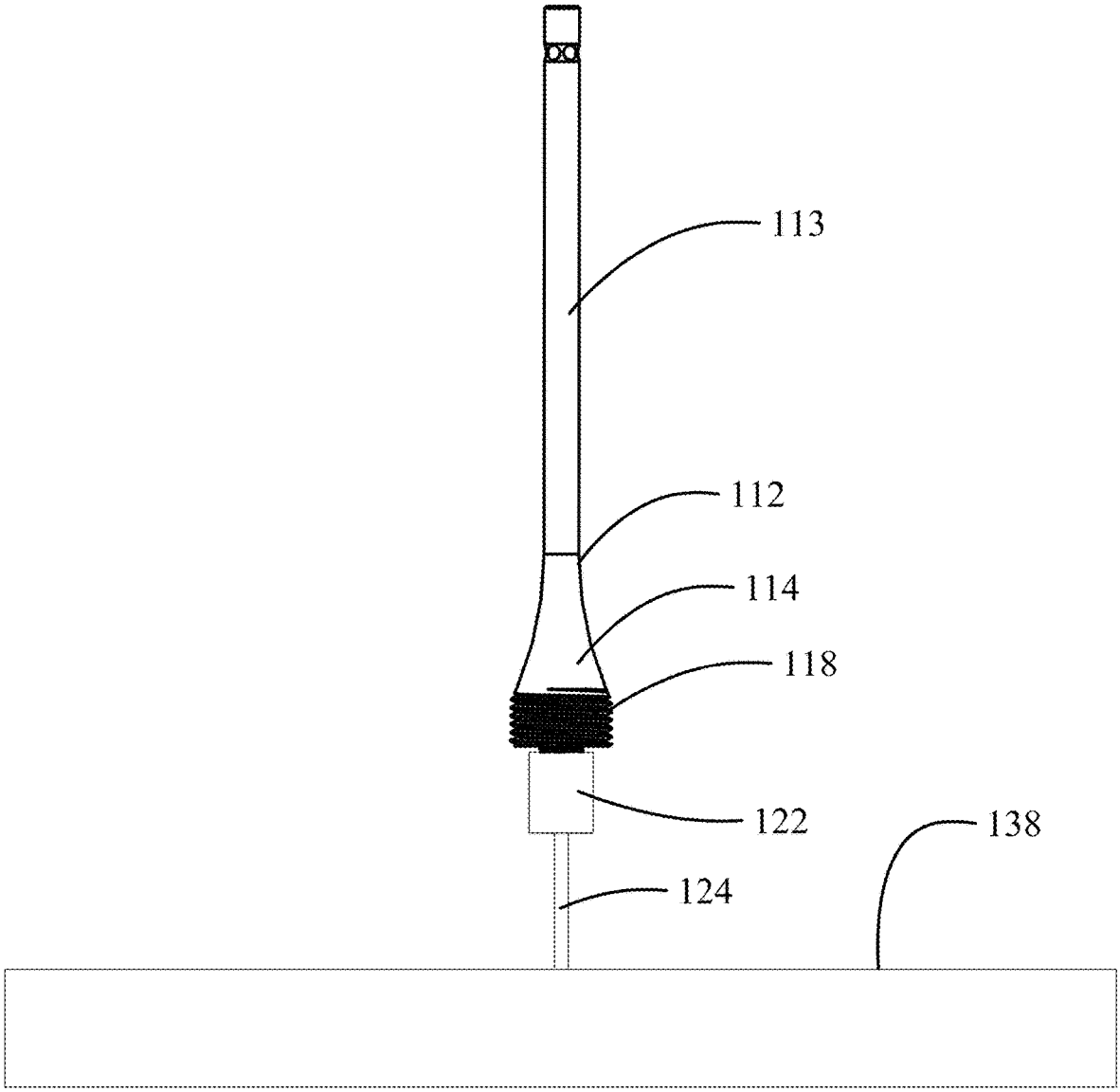
FIG. 1B is a side view of the inner element of the first embodiment engaged on a bit in a workpiece.
Figure 1C:
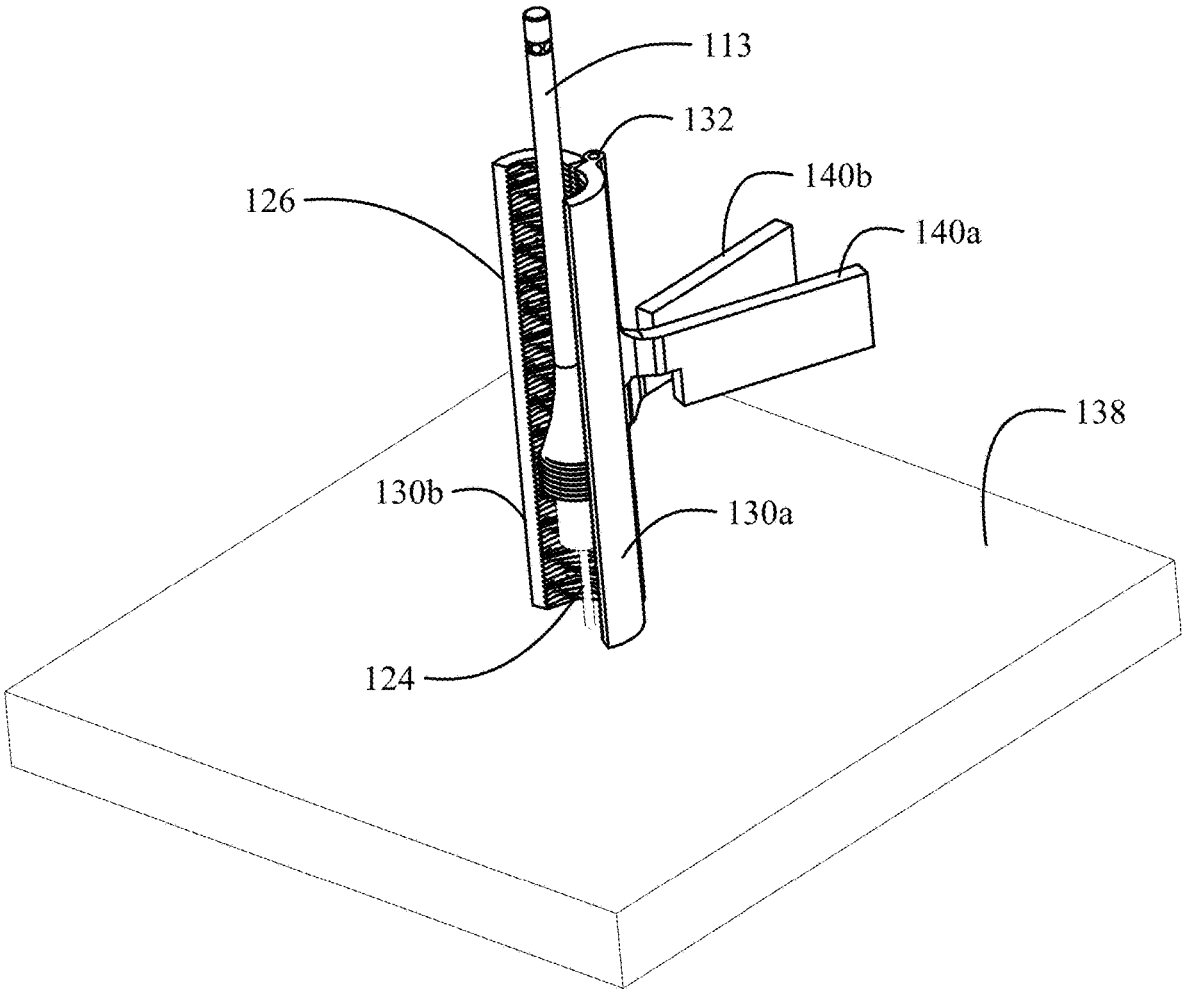
FIG. 1C is a pictorial representation of the first embodiment with the bifurcated sections of the outer element in the open position to engage the inner element.

Referring to the drawings, a first embodiment of a bit puller 110 is shown in FIGS. 1A-1C. Inner element 112 includes a central shaft 113 extending from a base 114 and terminating in a connector 116 at an end of the shaft distal from the base. The connector 116 is configured to be received in a drill motor for rotation as will be described subsequently. The base 114 has an internal bore 117 concentric with a longitudinal axis 119 and incorporating an attachment mechanism 120, such as male quick change connector for the embodiment shown, to couple to a mating attachment mechanism 122, a female quick change connector for the embodiment shown, at a drive end of drill bit 124 as seen in FIG. 1B. The attachment mechanism 120 is concentrically internal to the inner element 112 and engagement of the attachment mechanism 120 with the bit is accomplished solely by rotation of the inner element 112 about the longitudinal axis 119.

Base 114 additionally has an external thread 118. Outer element 126 is concentrically received over the inner element 112 and has an inner thread 128 which is adapted to engage the external thread 118 on the base 114. Outer element 126 is a hollow cylinder or partial cylinder bifurcated into two sections 130*a*, 130*b* which are attached with a longitudinal hinge 132 (parallel to the longitudinal axis 119) at mating first edges 134*a* and 134*b* of each section. Hinge 132 allows the two sections 130*a* and 130*b* to be opened to a first position as seen in FIG. 1C to be received around the inner element 112. This allows the inner element 112 to have the base 114 with attachment mechanism 120 engaged on the mating attachment mechanism 122 of the drill bit 124 at any height and the outer element 126 closed about the base 114 with a foot portion 136*a*, 136*b* of the sections 130*a*, 130*b* engaged flush with the workpiece 138.

Upon closing the outer element 126 to a closed position, the inner thread 128 engages the external thread 118. Rotation of the inner element 112 drives external thread 118 within inner thread 128 to longitudinally withdraw the inner element 112 away from the workpiece along the longitudinal axis 119 thereby exerting force on the bit to withdraw the bit from the workpiece. The pitch direction of outer thread 118 and inner thread 128 may be selected to either rotate the base 114 in a driving direction for the bit or a reversing direction.

For the embodiment shown, lever arms 140*a* and 140*b* extend from the sections 130*a* and 130*b* for assistance in rotation of the section on the hinge 132. When sections 130*a* and 130*b* are rotated to a closed position, lever arms 140*a* and 140*b* are brought into alignment and may be held closed or a locking mechanism such as a U clamp 142 received over the aligned lever arms 140*a*, 140*b* may be employed to lock the sections 130*a*, 130*b* in the closed position. For the embodiment shown, free edges 144*a* and 144*b* of the sections 130*a* and 130*b* are separated by a gap 146 as seen in FIG. 1A for relief to allow secure engagement of the sections 130*a* and 130*b* on the base 114. However, in alternative embodiment, the free edges 144*a* and 144*b* may be flush in the closed position. The sections 130*a* and 130*b* may be assembled over the base 114 with the base 114 at any height above the workpiece 138 at which the base 114 may be engaged to the drill bit 124 while allowing the foot portions 136*a* and 136*b* to remain in contact with the workpiece. This accommodates engagement of a drill bit which may be binding at an arbitrary height above the workpiece.

In operation, the base 114 of the inner element 112 is inserted onto the bit 124 receiving the bit with the internal attachment mechanism 120 engaging the mating attachment mechanism 122. The outer element 126 is opened by rotating sections 130*a* and 130*b* on hinge 132 as seen in FIG. 1C. The outer element 126 is then placed around the inner element 112 with the foot portion 136*a* and 136*b* of the sections 130*a* and 130*b* engaging the workpiece. The outer element 126 is then closed concentrically around the inner element 112 bringing the inner thread 128 into operable engagement with the external thread 118 as seen in FIG. 1A. The locking mechanism is engaged over the lever arms 136*a* and 136*b*. A drill motor is then attached to the connector 116 on the shaft 113. Operation of the drill motor rotates the inner element 112 withdrawing it on outer element 126 away from the workpiece and additionally rotating the bit thereby withdrawing the bit from the workpiece.

Figure 2A:
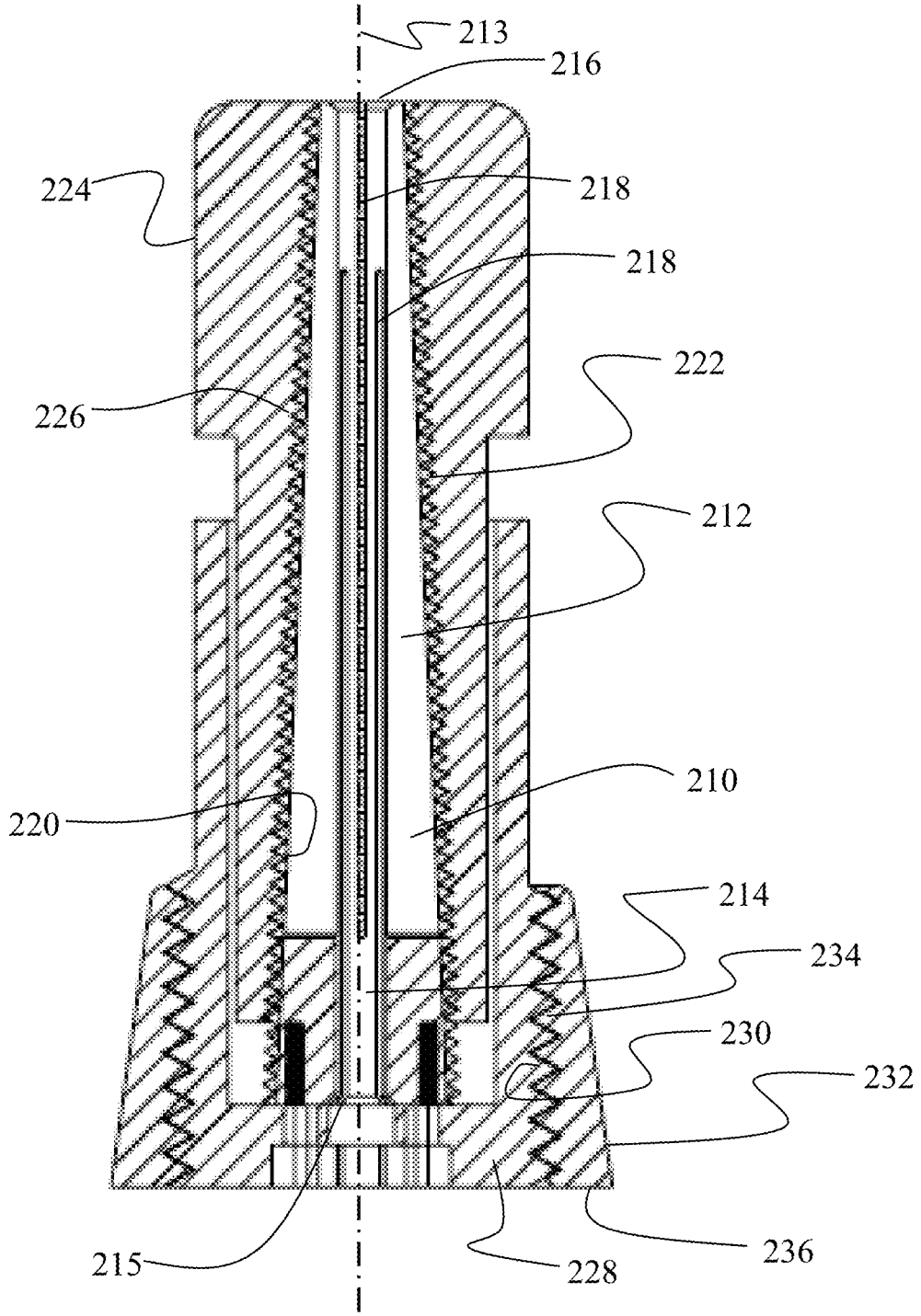
FIG. 2A is a section view of a second embodiment of the bit puller.
Figure 2B:
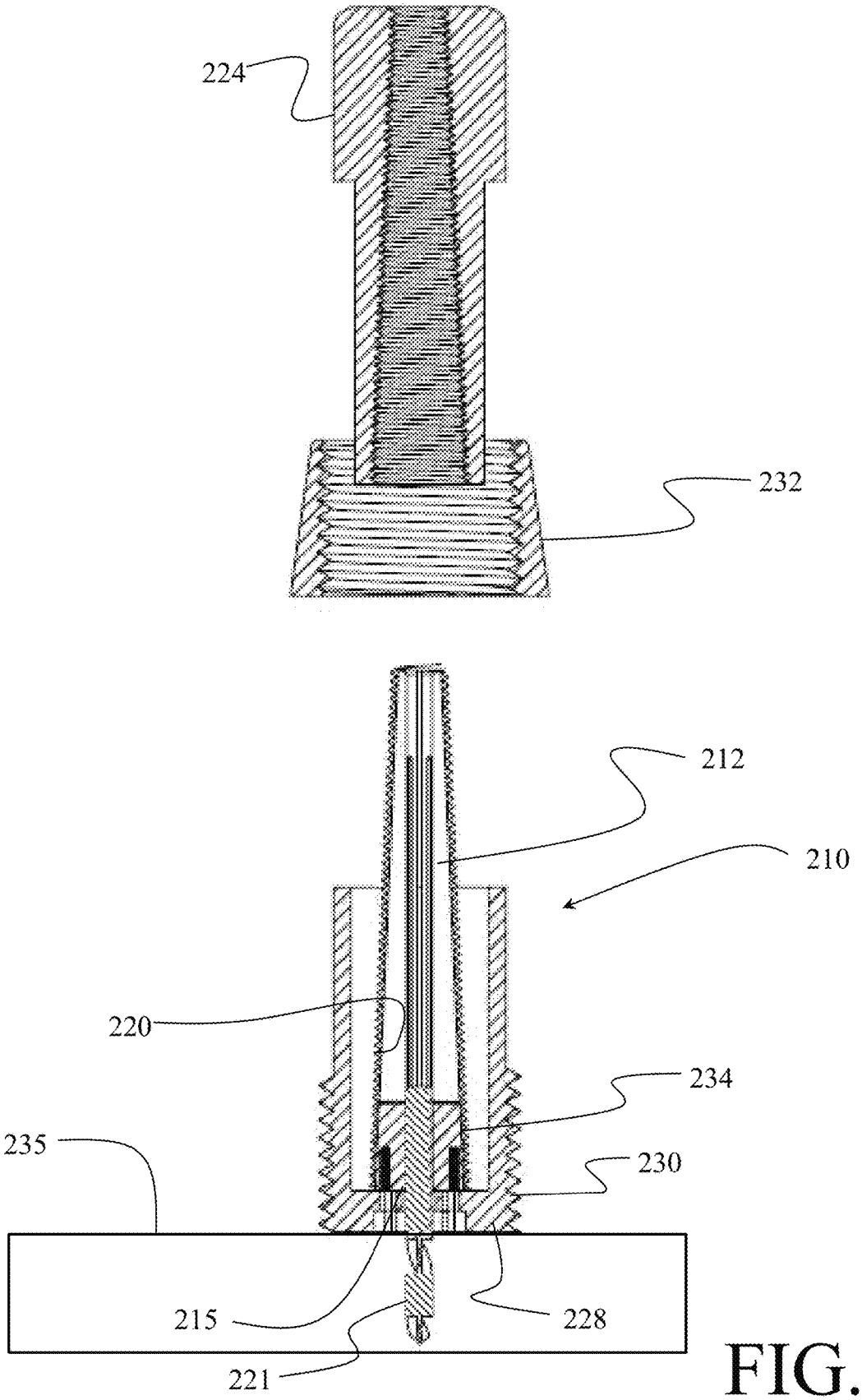
FIG. 2B is a section view of the inner element of the second embodiment concentrically received over a drill bit in a workpiece.
Figure 2C:
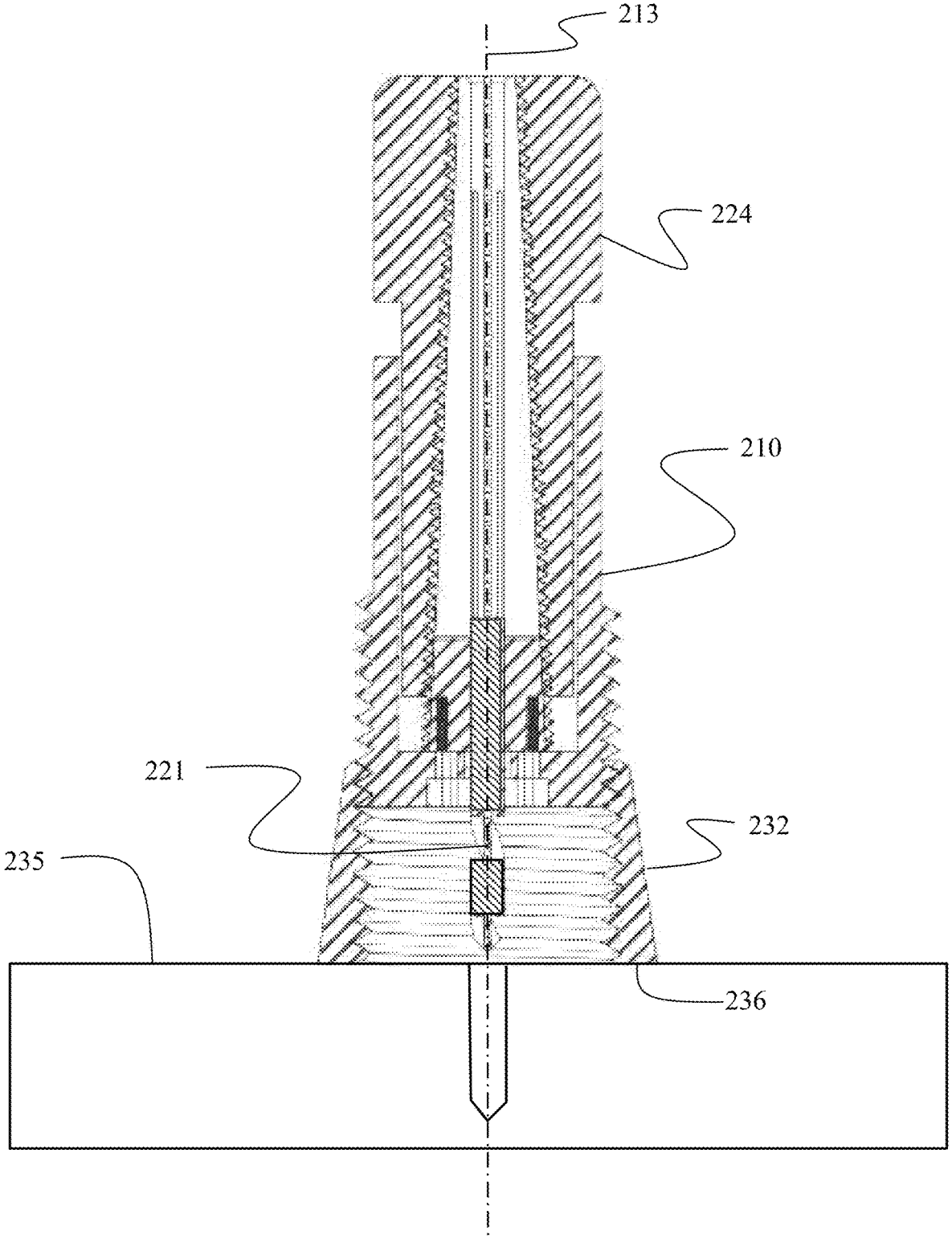
FIG. 2C is a section view of the second embodiment with the inner element withdrawn in the outer element along the longitudinal axis.

An enhanced embodiment is shown in FIGS. 2A-2C where an inner element 210 incorporates a central shaft 212 with a cavity 214 extending concentric to a longitudinal axis 213. The cavity 214 may extend from a lower end 215 of the central shaft 212 the full height of the shaft 212 as shown in the embodiment of the drawings or can only extend upward from the lower end toward (but not all the way to) an upper end 216 of the shaft 212. The central shaft 212 includes an attachment mechanism, for the embodiment shown alternating longitudinal slits 218 that allow the central cavity 214 to contract urging an inner surface 220 of the central cavity 214 into contact with a drill bit 221 positioned in the central cavity 214. The inner element 210 includes tapered threads 222 circumscribing the central shaft 212. A grip 224 includes a tapered bore 225 having complementary threads 226 to engage the threads 222 around the central shaft 212. Tightening of the grip 224 on the central shaft 212 forces the slits 218 closed contracting the cavity 214 about the drill bit 221 to clamp the inner surface 220 to the drill bit 221. As in the prior embodiment, the attachment mechanism is entirely circumferentially internal to the inner element and rotation of the grip about the longitudinal axis engages the drill bit.

The inner element 210 further includes a base, such as a collar 228 positioned concentrically with the central shaft 212 at the lower end 215. The collar 228 includes outer threads 230. The tool further includes an outer element 232 having inner threads 234 that mate with outer threads 230 of collar 228 the inner element 210. The complimentary threads 226 of the grip 224, tapered threads 222 of the central shaft 212, outer threads 230 of the collar 228, and inner threads 234 of the outer element 232 are configured with pitch direction selected to allow rotation of the grip 224 in a single direction to clamp the cavity 214 of the central shaft 212 onto the bit 221 and to rotate the inner element 210 respective to the outer element 232 urging the inner element upward from a workpiece 235 to pull the bit from the workpiece. The outer element 232 includes a foot portion 236 configured to contact and push against the workpiece as the inner element 210 is rotated.

In operation of the enhanced embodiment, the inner element 210 is placed over the bit 221 with the bit 221 extending into the central cavity 214, as seen in FIG. 2B. The outer element 232 is then received over the inner element 210 and rotated whereby the outer threads 230 of the collar 228 are engaged with the inner threads 234 of the outer element 232 over substantially the entire thread length with the bit 221 extended into the cavity 214 and the foot portion 236 engaging the workpiece 235. The grip 224 is then attached to the central shaft 212 of the inner element 210 with the complimentary threads 226 engaging the tapered threads 222 and rotated to compress the cavity 214 engaging the bit 221 as represented in FIG. 2C by the relative position of the grip and central shaft 212. Further rotation of the grip 224 initiates rotation of the inner element 210 in the outer element 232. As the inner element 210 rotates upward along on the threads of the outer element 232 as represented in FIG. 2C by the relative position of the inner element 210 and outer element 232, the inner element 210 and grip 224 removes the drill bit 221 from workpiece 235 along the longitudinal axis 213 of the tool.

Figure 3:
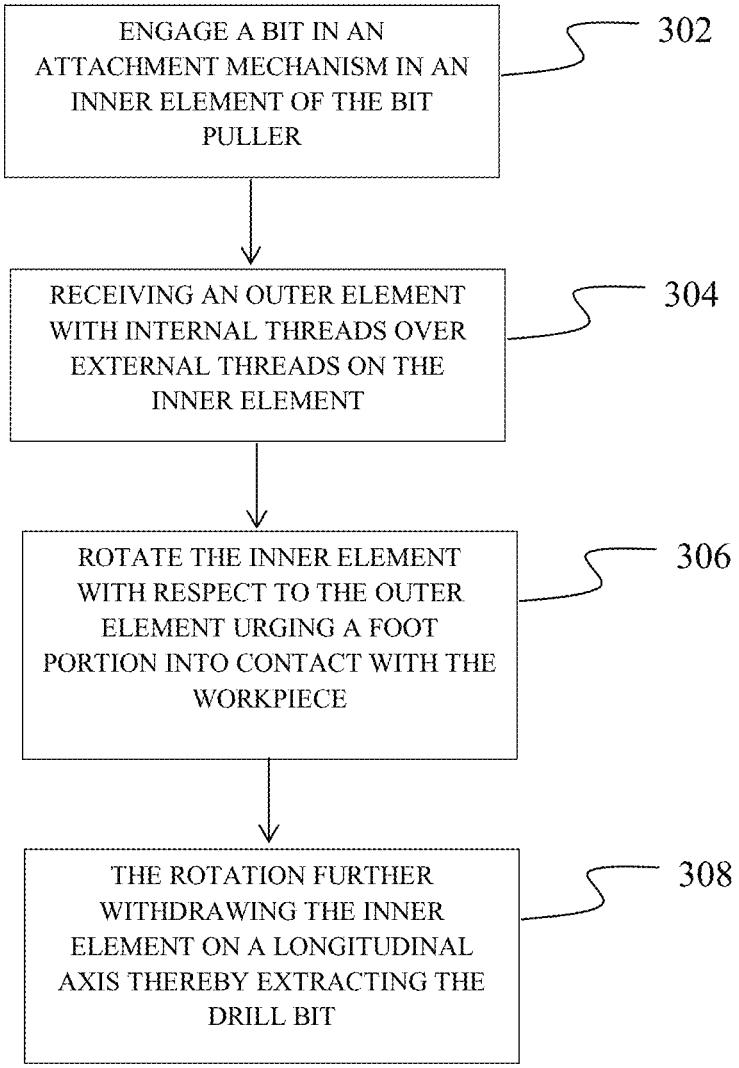
FIG. 3 is a flow chart showing a method for bit extraction using a tool embodiment as disclosed herein.

A method for extraction of a binding drill bit employing the embodiments disclosed is shown in FIG. 3 wherein a drill bit is engaged in an attachment mechanism in an inner element 112, 210, step 302. Engagement of the bit may be accomplished with a connector or a collapsing cavity in the inner element. An outer element 126, 232 having internal threads is received on external threads on the inner element, step 304. Rotation of the inner element with respect to the outer element urges a foot portion of the outer element into contact with a workpiece, step 306, and withdraws the inner element on a longitudinal axis, step 308, thereby extracting the drill bit.

Figure 4:
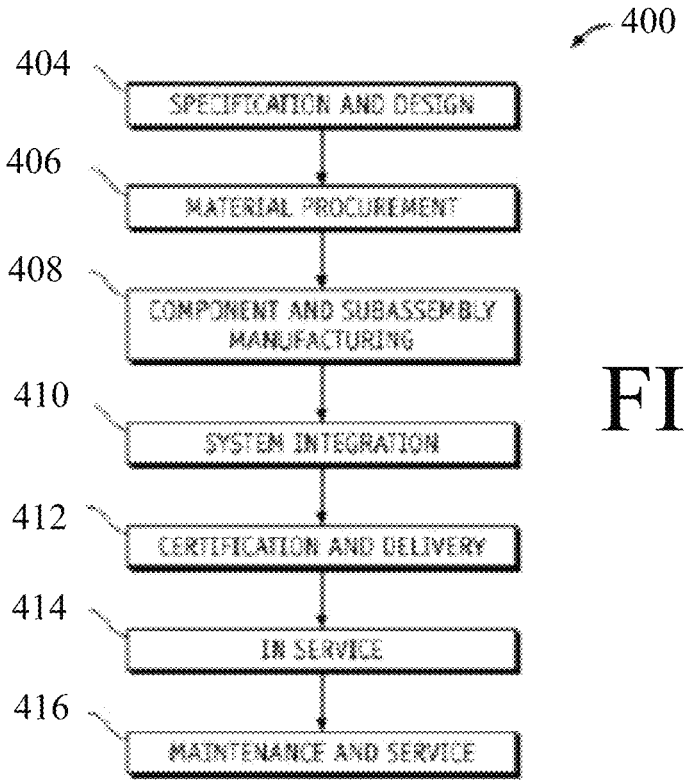
FIG. 4 is a flow chart depicting an aircraft manufacturing and service method in which the disclosed embodiments may be employed; and, FIG. 5 is a flow chart depicting an aircraft with which the disclosed embodiments may be employed.
Figure 5:
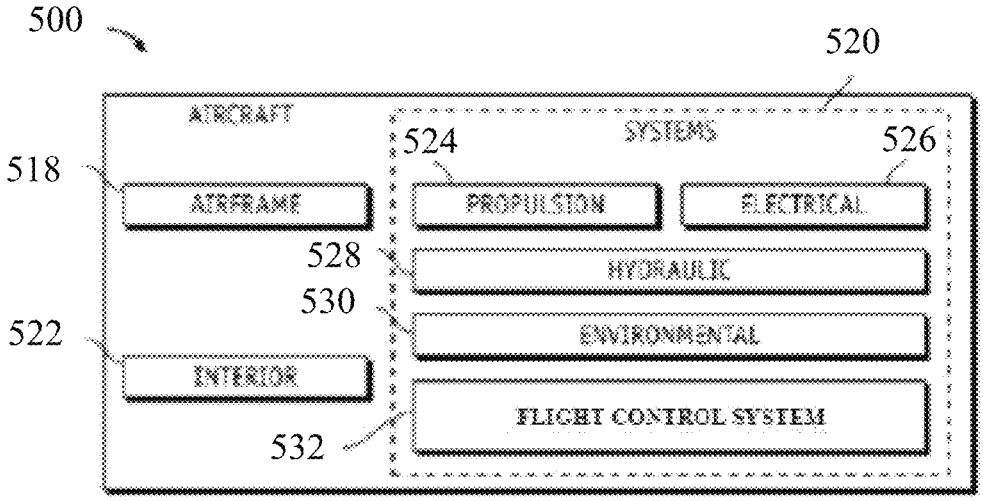

Embodiments of the disclosure may be employed in the context of an aircraft manufacturing and service method 400 (method 400) as shown in FIG. 4 and an aircraft 500 as shown in FIG. 5. During pre-production, the exemplary method 400 may include specification and design 404 of the aircraft 500 and material procurement 406. During production, component and subassembly manufacturing 408 and system integration 410 of the aircraft 500 takes place. Thereafter, the aircraft 500 may go through certification and delivery 412 in order to be placed in service 414. While in service by a customer, the aircraft 500 is scheduled for routine maintenance and service 416 (which may also include modification, reconfiguration, refurbishment, and so on). The tools described herein may be used, for example, during steps 408 and/or 416.

Each of the processes of method 400 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be without limitation an airline, leasing company, military entity, service organization, and the like.

As shown in FIG. 5, the aircraft 500 produced by the exemplary method 400 may include an airframe 518 with a plurality of systems 520 and an interior 522. Examples of high-level systems 520 include one or more of a propulsion system 524, an electrical system 526, a hydraulic system 528, an environmental system 530, and flight control system 532. Any number of other systems may also be included. Although an aerospace example is shown, the embodiments of the disclosure may be applied to other industries.

Apparatus and methods embodied herein and previously described may be employed during any one or more of the stages of the production and service method 400. For example, components or subassemblies corresponding to production process 408 may be fabricated or manufactured in a manner similar to components or subassemblies produced while the aircraft 500 is in service. In addition, one or more apparatus embodiments as described herein, method embodiments described herein, or a combination thereof may be utilized during the production stages 408 and 410, for example, by substantially expediting assembly of or reducing the cost of an aircraft 500. Similarly, one or more of apparatus embodiments, method embodiments, or a combination thereof may be utilized while the aircraft 500 is in service, for example and without limitation, to maintenance and service 416.

Having now described various embodiments of the disclosure in detail as required by the patent statutes, those skilled in the art will recognize modifications and substitutions to the specific embodiments disclosed herein. Such modifications are within the scope and intent of the present disclosure as defined in the following claims.

What is claimed is:

1. A method for extraction of a drill bit comprising:
engaging a drill bit in an engagement mechanism internal to an inner element;
receiving an outer element having internal threads on external threads on the inner element;
rotating the inner element with respect to the outer element urging a foot portion of the outer element into contact with a workpiece;
withdrawing the inner element on a longitudinal axis thereby extracting the drill bit.

2. The method as defined in claim 1 wherein the inner element has a longitudinal axis and
a central shaft,
a base, said base having external threads, and,
a cavity in the central shaft
wherein the step of rotating the inner element contracting the cavity to engage the drill bit.

3. The method as defined in claim 2 wherein the step of rotating the inner element further comprises rotating the inner element about the longitudinal axis.

4. The method as defined in claim 3 wherein the inner element further comprises a grip, the inner element having tapered threads circumscribing the central shaft and the grip having a bore with complimentary threads engaging the tapered threads and further comprising rotating the grip to compress the cavity engaging the bit.

5. The method as defined in claim 4 further wherein the outer element further comprises internal threads adapted to engage the external threads of the base wherein rotation of said inner element with respect to the outer element withdraws the inner element along the longitudinal axis.

6. The method as defined in claim 4 wherein the central shaft has slits and the step of rotating the grip to compress the cavity further comprises forcing the slits closed contracting the cavity about the drill bit to clamp an inner surface of the cavity to the drill bit.

7. The method as defined in claim 1 wherein engaging a drill bit in an engagement mechanism comprises:
concentrically placing the outer element over the bit with a foot portion engaging the workpiece;
placing the inner element over the bit with the bit extending into a central cavity in a shaft;
rotating the inner element whereby the outer threads of a collar are engaged with the inner threads of the outer element over substantially the entire thread length with the bit extended into the cavity;
attaching a grip to a central shaft of the inner element with complimentary threads on the grip engaging tapered threads on the shaft; and
rotating the grip to compress the cavity engaging the bit.

8. The method as defined in claim 7 further comprising:
further rotating the grip to initiate rotation of the inner element in the outer element;
rotating the inner element upward along on the threads of the outer element thereby removing the drill bit from the workpiece along the longitudinal axis.

9. The method as defined in claim 1 wherein engaging the drill bit is accomplished with a connector.

10. The method as defined in claim 1 wherein engaging the drill bit comprises collapsing a cavity in the inner element to bring an inner surface of the cavity into contact with the drill bit.

11. The method as defined in claim 1 wherein receiving an outer element comprises:

opening the outer element by rotating bifurcated sections on a longitudinal hinge to an open position;

placing the outer element around the inner element with a foot portion of the sections engaging the workpiece;

closing the outer element concentrically around the inner element bringing the internal threads into operable engagement with the external threads.

12. The method as defined in claim 1 wherein the inner element has a longitudinal axis and has a central shaft, and a base, said base having external threads;

and the outer element has a first bifurcated section;

a second bifurcated section attached to the first bifurcate section with a longitudinal hinge, said first and second bifurcated sections rotatable about the longitudinal hinge to an open position and rotatable to a closed position and wherein the step of receiving an outer element having internal threads on external threads on the inner element comprises rotating the first and second bifurcated sections to the open position;

receiving the bifurcated sections over the inner element; and rotating the first and second bifurcated sections to the closed position engaging the internal threads with the external threads.

13. The method as defined in claim 12 wherein the central shaft further comprises a connector distal from the base and further comprising the step of engaging the connector with a drill motor.

14. The method as defined in claim 13 wherein the step of rotating the inner element with respect to the outer element comprises rotating the connector with the drill motor.

15. The method as defined in claim 14 wherein the step of rotating the inner element comprises rotating the inner element about the longitudinal axis.

16. The method as defined in claim 12 wherein the outer element further comprises:

a first lever arm extending from the first bifurcated section; and a second lever arm extending from the second bifurcated section, said first and second lever arms aligned with the bifurcated sections in the closed position, and further comprising engaging the first and second lever arms in the closed position with a locking mechanism.

17. A method for extraction of a drill bit, the method comprising:

engaging a drill bit with an inner element with a longitudinal axis and having a central shaft, a base, said base having external threads, and, an engagement mechanism internal to the inner element wherein rotation of the inner element about the longitudinal axis engages the engagement mechanism on the drill bit;

engaging the inner element with an outer element concentric with the inner element and having a first bifurcated section and a second bifurcated section attached with a longitudinal hinge, said sections rotatable about the longitudinal hinge to an open position to be received about the inner element and rotatable to a closed position engaging the internal threads with the external threads;

a first lever arm extending from the first bifurcated section and a second lever arm extending from the second bifurcated section, said first and second lever arms aligned with the bifurcated sections in the closed position;

locking the first and second levers in the closed position;

engaging a work piece with foot portions on the first and second bifurcated sections; and rotating the central shaft urging the inner element from the outer element with the engaged internal and external threads.

18. The method of claim 17 further comprising engaging a connector on the shaft distal from the base with a drill motor and the step of rotating the central shaft comprises rotating the connector with the drill motor.

19. A method for extraction of a drill bit, the method comprising:

engaging a drill bit with inner element, said inner element having a longitudinal axis and a central shaft having a cavity and tapered threads circumscribing the central shaft, said cavity adapted to contract to engage the drill bit on an inner wall, a base, said base having external threads, and, a grip having a bore with complimentary threads engaging the tapered threads, engaging the inner element in an outer element, the outer element having a foot portion for engaging a work piece, and internal threads adapted to engage the external threads of the base, wherein the threads of the inner element, the tapered threads of the central shaft, external threads of the base, and inner threads of the outer element are complimentary and are configured with pitch direction selected to allow rotation of the grip in a single direction;

rotating the grip contracting the cavity to engage the drill bit; and further rotating the grip to rotate the inner element respective to the outer element urging the inner element upward from a workpiece.

20. The method of claim 19 wherein the central shaft has slits allowing the cavity to contract and step of rotating the grip contracting the cavity to engage the drill bit further comprises collapsing the slits to contract the cavity.

* * * * *